US008057006B2

(12) United States Patent
Rice et al.

(10) Patent No.: US 8,057,006 B2
(45) Date of Patent: Nov. 15, 2011

(54) FLUID EJECTION DEVICE

(75) Inventors: Huston W. Rice, Vancouver, WA (US); David B. Novak, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 707 days.

(21) Appl. No.: 11/977,539

(22) Filed: Oct. 24, 2007

(65) Prior Publication Data

US 2009/0109255 A1 Apr. 30, 2009

(51) Int. Cl.
*B41J 29/38* (2006.01)

(52) U.S. Cl. ..... 347/14; 347/19

(58) Field of Classification Search ..... 347/85, 347/86, 19, 14

See application file for complete search history.

(56) References Cited

U.S. PATENT DOCUMENTS 5,495,270 A * 2/1996 Burr et al. ..... 347/10
5,592,595 A 1/1997 Wakabayashi et al.
6,039,430 A 3/2000 Helterline et al.
6,065,824 A 5/2000 Bullock et al.
6,130,695 A 10/2000 Childers et al.
6,290,321 B1 9/2001 Murray et al.
6,290,346 B1 9/2001 Santhanam et al.
6,454,381 B1 9/2002 Olsen et al.
6,561,614 B1 * 5/2003 Therien et al. ..... 347/19
6,672,695 B1 1/2004 Tojyo et al.
6,719,397 B1 4/2004 Hu et al.
6,866,359 B2 3/2005 Pan et al.
6,923,531 B2 8/2005 Saruta
2001/0007458 A1 7/2001 Purcell et al.
2002/0041314 A1 4/2002 Santhanam et al.
2002/0060708 A1 * 5/2002 Elliott ..... 347/19
2002/0126301 A1 9/2002 Bowers
2005/0012791 A1 1/2005 Anderson et al.
2006/0244795 A1 11/2006 Hayasaki et al.
2007/0296769 A1 * 12/2007 Raman ..... 347/65

OTHER PUBLICATIONS

International Search Report for Application No. PCT/US2008/080813. Report issued May 29, 2009.

* cited by examiner

*Primary Examiner* — Laura Martin

(57) ABSTRACT

A fluid ejection device for use with a print system to eject fluid onto a substrate includes a fluid reservoir and an identifier associated with the fluid reservoir, wherein the identifier is fixed and specifies a nominal fluid ejection rate of fluid from the fluid reservoir.

26 Claims, 3 Drawing Sheets

Fig. 5

| | 11 | 10 | 01 | 00 |
|---|---|---|---|---|
| ECONOMY | 85% | 50% | 50% | 50% |
| DRAFT | 85% | 75% | 65% | 50% |
| NORMAL | 100% | 90% | 80% | 70% |
| BEST | 100% | 100% | 90% | 80% |

FLUID EJECTION DEVICE

BACKGROUND

Ink-jet printers frequently make use of an ink-jet printhead. Some printing components, such as ink containers and printheads, may be periodically replaced. Ink containers are replaced when exhausted. Printheads may be replaced at the end of printhead life.

The rate at which fluid such as ink is ejected onto a substrate influences the print quality level. The more fluid deposited on the substrate to form an image, the more saturated and detailed the image will appear, resulting in higher print quality. On the other hand, if the amount of ink dropped is decreased, the image formed on the substrate may appear less saturated and/or detailed, and thus of a lower print quality. In many cases, lower print quality may be acceptable; hence, draft and economy modes have long been present in printers and/or print driver software. Enabling easily-used draft and economy modes may be desirable to many users.

BRIEF DESCRIPTION OF THE DRAWINGS

FIG. 5 depicts an example lookup table relating identifiers to print modes to determine ink depletion levels and/or nominal fluid ejection rates in accordance with an embodiment of the present disclosure.

DETAILED DESCRIPTION

Figure 1:
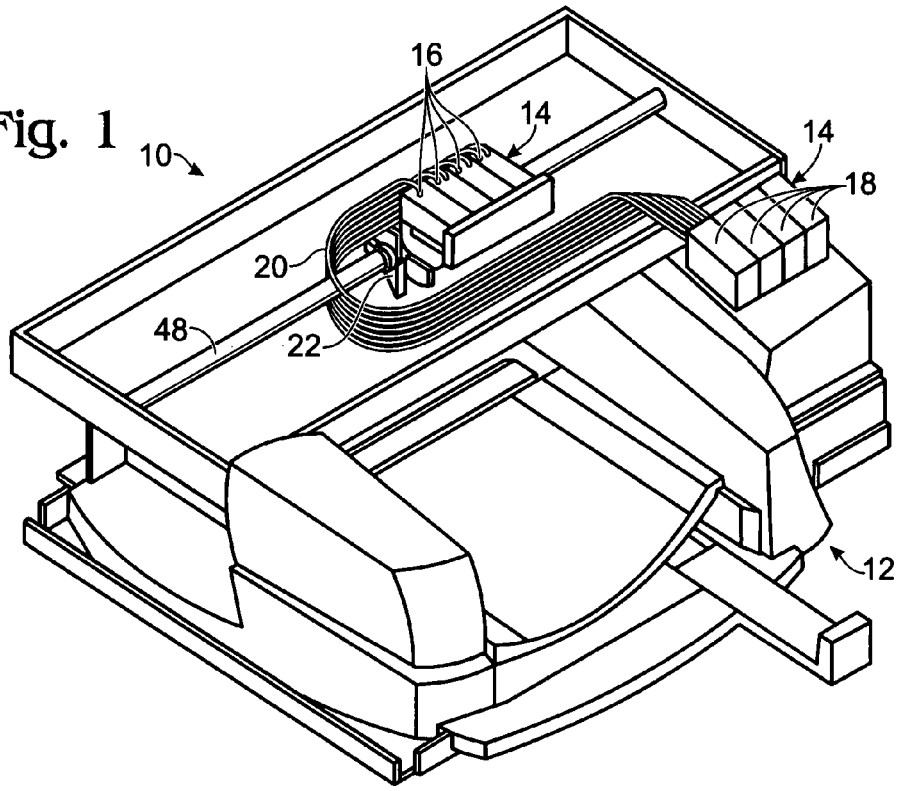
FIG. 1 depicts a perspective view of an example printing system, shown with the cover removed, that incorporates removable printing components in accordance with an embodiment of the present disclosure.

FIG. 1 is a perspective view of an example printing system 10, shown with its cover removed. In this example, printing system 10 is an ink-jet printing system. Other types of printing systems, such as laser or thermal, also may include disclosed devices, assemblies and/or apparatus. Further, printing system 10 may be used in a wide variety of applications such as facsimile machines, postal franking machines, copiers and large format type printing systems suitable for use in displays and outdoor signage. For the purposes of this disclosure, the term "fluid" encompasses all colors of ink as well as any other fluid used in printing systems. The term "fluid ejection device" encompasses components such as printhead 16 or printhead assemblies that are configured to eject fluid onto a substrate.

In this example, ink-jet printing system 10 includes a print mechanism 12 having a plurality of replaceable printing components 14 installed therein. Replaceable printing components 14 include printheads 16 for selectively depositing fluid such as ink onto a substrate (not shown) such as paper in response to control signals, and fluid reservoirs 18 for providing fluid to each printhead 16. As indicated, each printhead may be fluidically connected to corresponding fluid reservoirs 18 by a flexible conduit 20.

Printheads 16 are mounted in a scanning carriage 22, which may be scanned past print media as the substrate is stepped through a print zone. As printheads 16 move relative to the substrate, fluid may be selectively ejected from one or more nozzles disposed on printheads 16 to form images and text.

Although printing system 10 (shown in FIG. 1) makes use of fluid reservoirs 18 which are mounted off of scanning carriage 22, other configurations are possible. For instance, replaceable ink containers 18 may be mounted on scanning carriage 22. Printhead 16 and fluid reservoir 18 also may be incorporated into an integrated printhead assembly. The term "fluid ejection device" is used herein to describe all such embodiments.

One aspect of the present disclosure relates to a device, printhead assembly and apparatus for controlling fluid ejection rates based on information contained on replaceable printing components 14. An identifier may be associated with replaceable printing component 14.

The identifier may be any value or indicia communicable to print mechanism 12 to ensure appropriate print quality. The identifier may specify, either directly or indirectly, a nominal fluid ejection rate associated with replaceable printing component 14.

The nominal fluid ejection rate is the rate at which print mechanism 12 causes a fluid ejection device (e.g., printhead 16 or a printhead assembly) to eject fluid onto a substrate such as paper. In cases where the identifier specifies the nominal fluid ejection rate directly, the identifier may be a value, such as a nominal drop volume or a percentage of total possible drop volume. In other cases, the identifier may be an arbitrary value, such as a number, which print mechanism 12 or print software driver may utilize to determine the nominal fluid ejection rate.

Figure 2B:
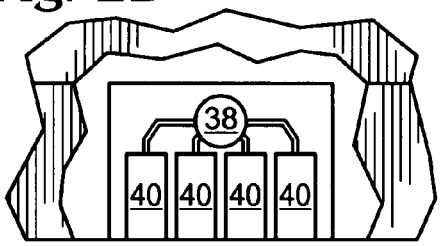
FIGS. 2A and 2B together depict a schematic representation of the embodiment of printing system shown in FIG. 1, illustrating an embodiment of a removable ink container and an embodiment of a printhead, each containing an electrical storage device storing an identifier.

In some embodiments, the identifier may be a value stored in electrical storage device 38. Electrical storage devices 38 may also be referred to as information storage devices or memory, and may be used for storing other information related to the corresponding replaceable printer components besides the identifier. As best illustrated in FIG. 2B, a plurality of electrical contacts 40 may be provided on each replaceable printing component 14, each contact being electrically connected to electrical storage device 38. Some electrical storage devices may comprise a relatively small amount of circuitry. For instance, the embodiment shown in FIG. 5 includes 2 bits, allowing for four distinct identifier values. Electrical storage device may be any type of computer memory, such as non-volatile memory (e.g., one-time writable electrical memory components such as EPROM or EEPROM), one or more fuses, or the like.

In other embodiments, the identifier may include a mechanical structure, such a tab or an arrangement of columns similar to those shown in U.S. Pat. No. 6,290,346 or U.S. Patent Application No. 2002/0041314, both of which are assigned to the assignee of the present disclosure, and both of which are incorporate by reference for all purposes. A print mechanism may be configured to detect such mechanical structures and to calculate a nominal fluid ejection rate therefrom. In yet other embodiments, visual components, such as light emitting diodes, barcodes or RFID tags, may be used to convey the identifier from replaceable printing component 14 to print mechanism 12.

In any of the above examples, the identifier associated with each fluid reservoir 18 may be unique to that particular fluid reservoir. The particular information conveyed by an identifier will be discussed in more detail below.

In some embodiments, the nominal fluid ejection rate may be related to the initial volume of fluid contained within fluid reservoir 18. For instance, an economy fluid ejection device may include a fluid reservoir 18 containing a volume of fluid that is less than that of a high quality fluid ejection device. However, the economy fluid ejection device may last as long or longer than the high quality fluid ejection device because despite having less fluid, the nominal fluid ejection rate of the economy fluid ejection device may be less than that of the high quality device.

The rate at which print mechanism 12 causes a fluid ejection device to eject fluid onto a substrate may be adjusted (e.g., to achieve a nominal fluid ejection rate) in a number of ways. In some embodiments, the fluid ejection rate may be adjusted by controlling the size of droplets ejected onto the substrate by one or more nozzles on a printhead 16 or printhead assembly. Additionally or alternatively, some embodiments may control the number of droplets of fluid deposited in square area of a substrate, hereafter referred to as a "unit square."

Installation of replaceable printing component 14 into print mechanism 12 allows print mechanism 12 to obtain the identifier. The identifier provided from replaceable printing components 14 to printing mechanism 12 may be used alone or in combination with other information, such as one or more print quality modes, to determine the nominal fluid ejection rate at which print mechanism 12 causes printhead 16 or a printhead assembly to eject fluid onto a substrate.

Figure 2A:
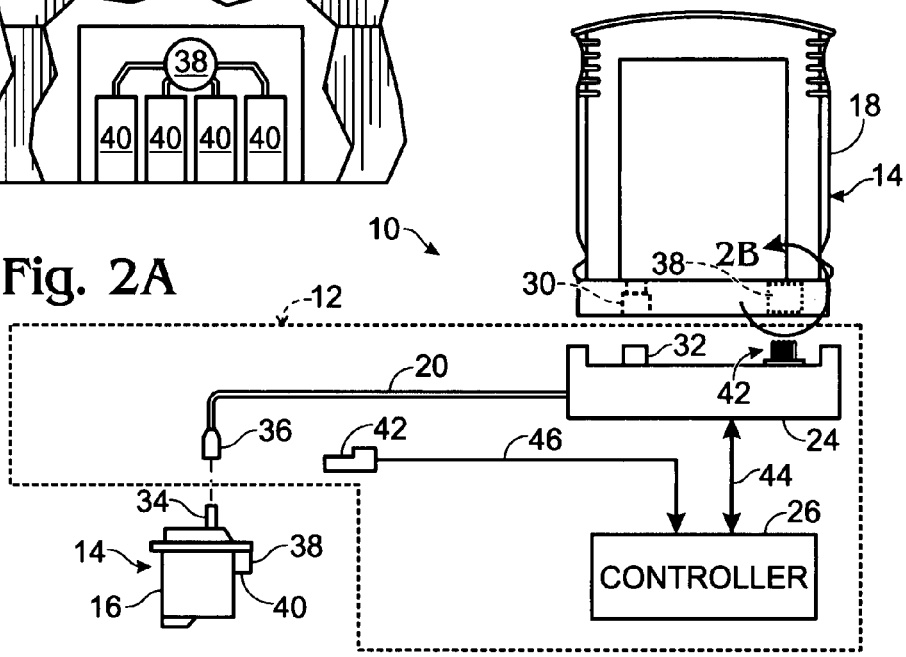

FIGS. 2A and 2B depict a schematic representation of the printing system shown in FIG. 1. FIGS. 2A and 2B are simplified to illustrate a single printhead 16 and a single fluid reservoir 18 for accomplishing single-color printing. Where more than one color is desired, a plurality of printheads 16 may be used, each having an associated fluid reservoir 18 as shown in FIG. 1.

Print mechanism 12 may include a fluid reservoir receiving station 24 and a controller 26. With fluid reservoir 18 properly inserted into fluid reservoir receiving station 24, an electrical and a fluidic coupling is established between fluid reservoir 18 and print mechanism 12. The fluidic coupling allows fluid stored within fluid reservoir 18 to be provided to printhead 16. The electrical coupling allows information to be passed between fluid reservoir 18 and print mechanism 12/controller 26, ensuring appropriate print quality of printing system 10.

Fluid reservoir 18 may include a fluid outlet 30 that is in fluid communication with fluid reservoir 18. Fluid outlet 30 may be configured for connection to a complimentary fluid inlet 32 associated with fluid reservoir receiving station 24.

Printhead 16 includes a fluid inlet 34 configured for connection to a complimentary fluid outlet 36 associated with print mechanism 12. With the printhead properly inserted into scanning carriage 22 (shown in FIG. 1), fluid communication may be established between the printhead and fluid reservoir 18 by way of flexible fluid conduit 20.

Controller 26 may control the transfer of information between print mechanism 12 and replaceable printing components 14. For instance, controller 26 may control the transfer of information between printhead 16, fluid reservoir 18, and controller 26. Controller 26 also may control the relative movement of printhead 16 and the substrate, as well as selectively activating printhead 16 to eject ink onto print media at various ejection rates.

Figure 3:
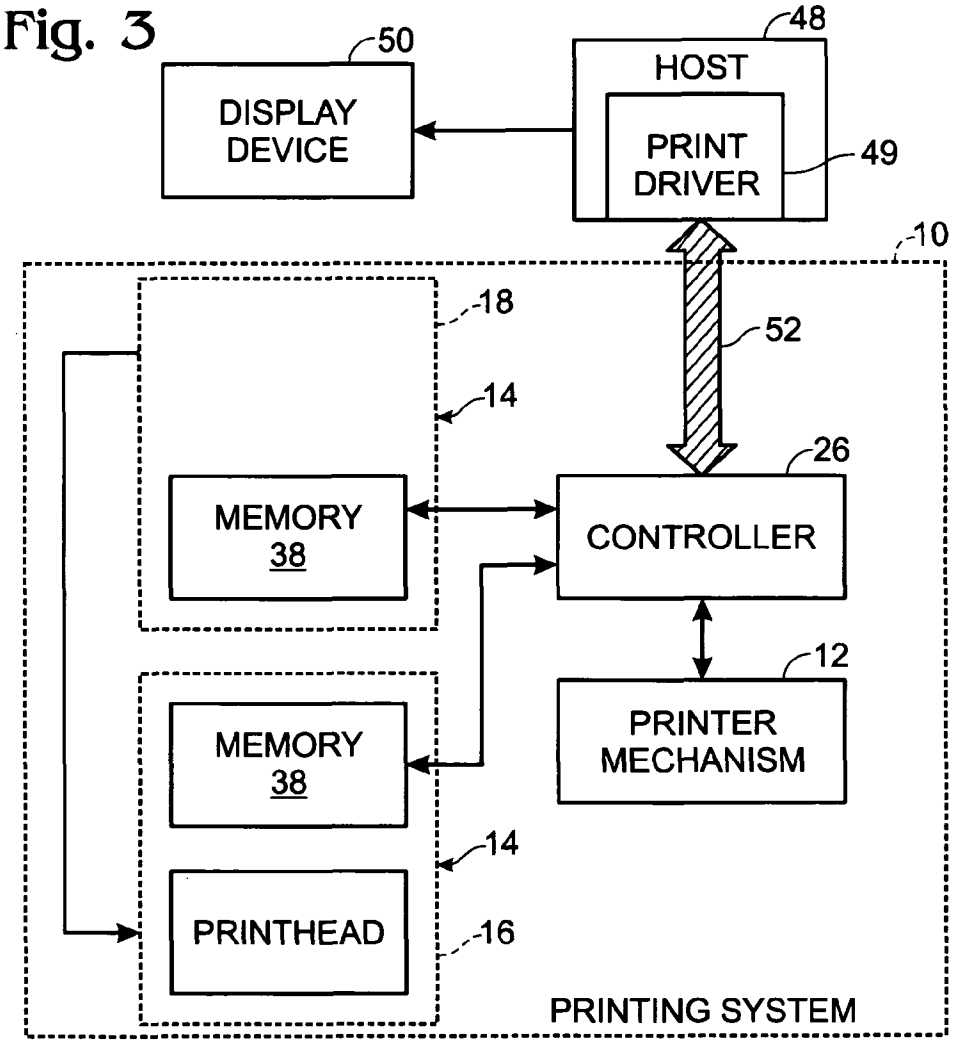
FIG. 3 depicts a schematic block diagram of the embodiment of the printing system of FIG. 1 shown connected to a host.

FIG. 3 represents a block diagram of an example printing system 10 similar to the one shown in FIGS. 1, 2A and 2B, shown connected to an information source or host computer 48. Host 48 is shown having a print software driver 49 executing thereon and being connected to a display device 50. Host 48 may be any of a variety of information sources (such as a personal computer, work station, or server, to name a few) that provides image information to controller 26 by way of a data link 52. Data link 52 may be any of a variety of conventional data links (such as an electrical link, infrared link, a wide-area or local-area network link, or any other well-known data link) for transferring information between host 48 and printing system 10. Host 48 may provide image description information or image data to printing system 10 for forming images on print media.

Controller 26 and/or print software driver 49 may include one or more print quality modes, such as "draft", "normal", and "best". Print quality modes may be used in conjunction with identifiers associated with replaceable printing components 14 to determine the nominal fluid ejection rate. Controller 26 and/or print software driver 49 may further utilize a lookup table, contained in the memory of the host 48 or memory (not shown) associated with the printing system 10, to determine the nominal fluid ejection rate.

Figure 4:
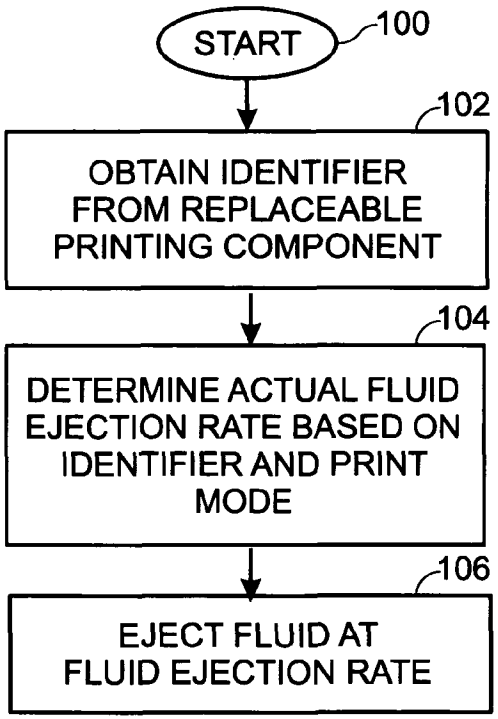
FIG. 4 depicts an example process used to determine a nominal fluid ejection rate of a replaceable printing component using a lookup table such as the one shown in FIG. 5 in accordance with an embodiment of the present disclosure.

Referring now to FIG. 4, print mechanism 12 may be configured to receive at 100 replaceable printing component 14 such as a printhead assembly, having an identifier associated therewith. At 102, print mechanism 12 may obtain the identifier from the replaceable printing component 14. At 104, print mechanism 12 may determine the nominal fluid ejection rate by relating the identifier to a lookup table such as the one depicted in FIG. 5. Alternatively, print software driver 49 executing on a host 48 attached to print mechanism 12 may determine the nominal fluid ejection rate by relating the identifier to a lookup table contained in memory associated with the host. At 106, print mechanism 12 may eject fluid onto a substrate at the nominal fluid ejection rate to produce an image.

FIG. 5 is a representation of an example lookup table usable to relate an identifier to a print mode to obtain a nominal fluid ejection rate. In this example the identifier includes two bits on the fluid reservoir 18, the bits being readable by the controller 26. The values in the example table represent percentages of total possible fluid ejection rates at which to eject fluid onto a substrate. It should be understood that any value affecting the fluid ejection rate may utilized in a lookup table according to the present disclosure.

There are four possible values achievable with two bits (seen across the top row): 11, which in this example represents a high quality fluid ejection device; 10, which represents a standard quality fluid ejection device; 01, which represents a first type of depleted fluid ejection device; and 00, which represents a second type of deplete fluid ejection device configured for lower quality that the first type. While an identifier having two bits is shown in FIG. 5, it should be understood that any number of bits may be used, representing any number of fluid ejection device types.

Some identifiers such as those shown in FIG. 5 may be stored in two one-time writeable bits, where the bits are written from 0 to 1, and not vice-versa. In such cases, it may be possible to modify the bits to arrive at a higher quality level, but not possible to modify the bits to arrive at a lower quality level; it may be impossible to modify a high quality fluid ejection device into a lower quality fluid ejection device as both bits already are set irreversibly to 1.

There are four print modes shown in FIG. 5: BEST, which indicates a high level of print quality; NORMAL, which indicates a standard or default type of print quality; DRAFT, which represents a level of print quality somewhat diminished from normal; and ECONOMY, which represents a lowest print quality level. While four print modes are shown in FIG. 5, it should be understood that any number of print quality modes are possible.

As an illustrative example, a printhead assembly has two bits programmed as identifier 01, identifying the cartridge as a first type of depleted fluid ejection device. Likewise, print mechanism 12 configured to receive the printhead assembly may be configured to print in DRAFT mode and contains in its memory the lookup table illustrated in FIG. 4. Upon insertion of the printhead assembly into the printer, the printer relates the identifier (01) to the print mode (DRAFT) to ascertain an actual fluid ejection rate of 65%. If the printer were later adjusted to print in BEST mode, then the printer would relate the identifier (01) to the table to calculate an actual fluid ejection rate of 90%.

It is believed that the disclosure set forth above encompasses multiple distinct embodiments of the present disclosure. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, possibly having or not having two or more such elements.

What is claimed is:

1. A fluid ejection device for use with a print system to eject fluid onto a substrate, the fluid ejection device comprising:

a fluid reservoir; and an identifier associated with the fluid reservoir, wherein the identifier is fixed and specifies a nominal fluid ejection rate of fluid from the fluid reservoir.

2. The fluid ejection device of claim 1 wherein the print system uses a print mode in combination with the identifier to determine the nominal fluid ejection rate.

3. The fluid ejection device of claim 1 wherein the identifier is stored in a one-time writable electrical memory component.

4. The fluid ejection device of claim 1 wherein the nominal fluid ejection rate is related to an initial volume of fluid stored in the fluid reservoir.

5. The fluid ejection device of claim 1 wherein the print system causes the fluid ejection device to eject fluid at the nominal fluid ejection rate by controlling a drop volume of individual ejected fluid droplets.

6. The fluid ejection device of claim 1 wherein the print system causes the fluid ejection device to eject fluid at the nominal fluid ejection rate by controlling a number of droplets ejected onto a unit square of the substrate.

7. The fluid ejection device of claim 1 wherein different percentages of fluid ejection rates for different print modes of the print system are associated with the identifier.

8. The fluid ejection device of claim 7 wherein the fluid ejection rate for each respective print mode is adjusted to achieve the nominal fluid ejection rate.

9. A printhead assembly for use with an ink-jet printer, the assembly comprising:

an ink reservoir;

one or more nozzles configured to eject ink from the ink reservoir onto a substrate; and an identifier associated with the ink reservoir, wherein the identifier is fixed and specifies a nominal ink ejection rate of ink from the ink reservoir.

10. The printhead assembly of claim 9 wherein the identifier is stored in a one-time writable electrical memory component.

11. The printhead assembly of claim 9 wherein the nominal ink ejection rate is related to an initial volume of ink stored in the ink reservoir.

12. The printhead assembly of claim 9 wherein the ink-jet printer causes the one or more nozzles to eject ink at the nominal ink ejection rate by controlling a drop volume of individual ink droplets ejected from at least a first nozzle.

13. The printhead assembly of claim 9 wherein the one or more nozzles is a plurality of nozzles, and the ink-jet printer causes the plurality of nozzles to eject ink at the nominal ink ejection rate by controlling a number of droplets ejected onto a unit square of the substrate.

14. The printhead assembly of claim 9 wherein the ink-jet printer uses a print mode in combination with the identifier to determine the nominal ink ejection rate.

15. The printhead assembly of claim 9 wherein different percentages of ink ejection rates for different print modes of the ink-jet printer are associated with the identifier.

16. The printhead assembly of claim 15 wherein the ink ejection rate for each respective print mode is adjusted to achieve the nominal fluid ejection rate.

17. An apparatus for controlling the fluid ejection rate in a printing system having a printer configured to receive a fluid reservoir and eject fluid onto a substrate, the apparatus comprising:

means for identifying the fluid reservoir with a fixed identifier;

means for calculating a nominal fluid ejection rate of fluid from the fluid reservoir based at least in part on the fixed identifier for the fluid reservoir; and means for ejecting fluid onto the substrate at the nominal fluid ejection rate.

18. The apparatus of claim 17 wherein the calculating means is further configured to calculate the nominal fluid ejection rate based at least in part on one or more print modes associated with the printer.

19. The apparatus of claim 17 wherein the calculating means is further configured to calculate the nominal fluid ejection rate based at least in part on one or more print modes associated with print driver software executing on a computer, the computer being in communication with the printer.

20. The apparatus of claim 17 wherein the identifying means further identifies an initial volume of fluid contained in the fluid reservoir.

21. The apparatus of claim 17 wherein the calculating means is further configured to calculate the nominal fluid ejection rate by relating the fixed identifier for the fluid reservoir to a first fluid ejection rate contained in a lookup table.

22. The apparatus of claim 17 wherein the identifying means comprises a one-time writable electrical memory component.

23. The apparatus of claim 17 wherein the ejecting means ejects fluid at the nominal fluid ejection rate by controlling a drop volume of individual fluid droplets ejected onto the substrate.

24. The apparatus of claim 17 wherein the ejecting means ejects fluid at the nominal fluid ejection rate by controlling a number of individual fluid droplets ejected onto a unit square of the substrate.

25. The apparatus of claim 17 wherein the identifying means provides different percentages of ink ejection rates for different print modes of the printer.

26. The apparatus of claim 25 wherein the ejecting means is further configured to adjust the ink ejection rate for each respective print mode to achieve the nominal fluid ejection rate.

* * * * *